United States Patent [19]

Palloch et al.

[11] 4,328,404

[45] May 4, 1982

[54] ACTUATION APPARATUS FOR A CONTROL SWITCH

[75] Inventors: Herbert Palloch, Schwetzingen; Hans Erndt, Wiesloch, both of Fed. Rep. of Germany

[73] Assignee: Frankl & Kirchner GmbH & Co. KG, Fabrik für Elektromotoren u. elektrische Apparate, Schwetzingen, Fed. Rep. of Germany

[21] Appl. No.: 137,891

[22] Filed: Apr. 7, 1980

[30] Foreign Application Priority Data

Apr. 6, 1979 [DE] Fed. Rep. of Germany ..... 2913861
Mar. 13, 1980 [DE] Fed. Rep. of Germany ..... 3009668

[51] Int. Cl.[3] ..... H01H 3/04

[52] U.S. Cl. ..... 200/153 SC; 200/335; 200/336

[58] Field of Search ..... 200/335, 153 SC, 16 R, 200/153 H, 257, 336, 337

[56] References Cited

U.S. PATENT DOCUMENTS 2,875,288 2/1959 White ..... 200/336
4,100,868 7/1978 Reinecke et al. ..... 112/277

FOREIGN PATENT DOCUMENTS 2835879 3/1979 Fed. Rep. of Germany ..... 200/337
769509 8/1934 France ..... 200/337
164994 4/1971 Netherlands ..... 200/335

OTHER PUBLICATIONS

"Bekleidung and Wäshche", No. 7, 1970, pp. 466–470.

*Primary Examiner*—Willis Little
*Attorney, Agent, or Firm*—Browdy and Neimark

[57] ABSTRACT

An actuation apparatus for a control switch which, in accordance with the position of a switching member, produces various control signals, in which an actuation arm coupled with the switching member is provided. The actuation arm is pivotable out of a central position of rest about a pivoting shaft counter to the restoring force of a torsion spring provided with free arms. A respective stationary initial stop is provided for each arm for the purpose of fixing the arm position in the position of rest and in which at least one coupler in contact with the free arms is connected with the actuation arm. At least one second stop, which acts as an end stop, is operatively associated with each free arm of the torsion spring to define the end of the switching paths.

15 Claims, 6 Drawing Figures

ACTUATION APPARATUS FOR A CONTROL SWITCH

BACKGROUND OF THE INVENTION

This invention relates to an actuation apparatus for a control switch which, in accordance with the position of a switching member, produces various control signals, in which an actuation arm coupled with the switching member is provided. The present invention relates more particularly to such an actuation device provided with an actuation arm which is pivotable out of a central position of rest about a pivoting shaft counter to the restoring force of a torsion spring provided with off-standing free arms, in which one stationary initial stop is provided for each free arm for the position of these in a position of rest and in which at least one coupler in contact with the free arms is connected with the actuation arm.

Actuation apparatuses of the above-mentioned type are particularly used in closed-looped and open-looped drives for sewing machines and the like, such as are known from the periodical *Bekleidung und Wasche,* No. 7, 1970, pages 446–470. Close-looped and opened-looped drives of this type are also known from the German Federal Republic Design Application 75 39 310, corresponding to U.S. Pat. No. 4,100,868. The actuation apparatus in this known apparatus is actuated via a pedal which can be actuated by the seamstress with her foot. The transmission of motion from the pedal to the actuation apparatus is effected via a rod linkage. When the switching member of the control switch moves in one direction out of the position of rest, various rotary speeds of the drive, which increase with the degree of deflection out of the position of rest, are triggered, while if the actuation arm pivots out of the position of rest in the opposite direction, for instance, other functions are triggered such as the actuation of a thread cutter or the like.

Control switches of this kind are known; switching can take place in discrete steps or in an ungraduated fashion as well. These switches can furthermore function using contact banks or may be embodied without contacts.

In a known actuation apparatus such as the apparatus described in the first paragraph of the present application, the free arms of the torsion spring are bent towards one another and lie in contact with a stationary stop disposed between them. A coupler coupled with the actuation arm is further disposed between them, which defines the position of the actuation arm. Upon the movement of the actuation arm in one or the other direction, one free arm of the other is deflected, generating a corresponding restoring force. A limitation of the switch travel is obtained in that the coupler is simultaneously guided in a stationary oblong slot of a housing, the ends of which represent the end stops for the coupler. A so-called pressure point i.e. a perceptable increase in the necessary adjustment force before the beginning of the actual switching procedures is effected by an extensive, spring-loaded lever linkage which is connected via cam connections with the actuation arm.

SUMMARY OF THE INVENTION

It is accordingly a principal object of the present invention to provide an actuation apparatus of the type described above which is particularly simple in structure and which, in particular, enables the especially simple generation of a pressure point.

In accordance with the present invention the foregoing object, as well as others which are to become clear from the text below, is achieved in an actuation apparatus as described above, by providing a respective second stop, acting as an end stop which limits the switching path associated with each free arm of the torsion spring. Because the arms of the torsion spring itself are utilized not only to fix the beginning of the switching path and thus the position of rest of the actuation arm but also to fix the end of the switching path, all the features previously required to achieve this result may be omitted.

This embodiment of the invention furthemore makes it possible to place a second torsion spring upon the same pivoting shaft, which spring is deflected in the same manner between the initial stop and the end stop by the coupler or couplers; in this case, there is a degree of play only in the position of rest between the coupler and the particular spring arm, so that the coupler first deforms the one arm and then, at the beginning of the actual switching procedure of the control switch, comes into contact with the second arm, which is also pre-stressed, so that this pre-stressing force must first be overcome only at one point, i.e. without moving the coupler. As a result, a so-called pressure point is generated which is associated variously with both or with only one of the switching directions.

The above-mentioned embodiment enables extremely simple construction for the end stops, which can be embodied as respective slits in a guide body.

In a further embodiment, the actuation apparatus is further modified in such a manner that even with large switching forces damage to the arms of the torsion spring in the area of the end stops is precluded. In this embodiment, the limitation of the switching paths of the torsion spring is effected with the interposition of the appropriate coupler. The coupler itself, and the protrusions on the guide body as well, against which the particular protrusion cover to rest, can be embodied much more sturdily then the end of the particular arm of the torsion spring. Furthermore, in this embodiment as well, the same advantages are obtainable as in the first-described embodiment.

BRIEF DESCRIPTION OF THE DRAWINGS

The invention is to be better understood and further objects and advantages thereof become more apparent from the ensuing detailed description of preferred embodiments taken in conjunction with the accompanying drawings.

DESCRIPTION OF THE PREFERRED EMBODIMENT

Figure 1:
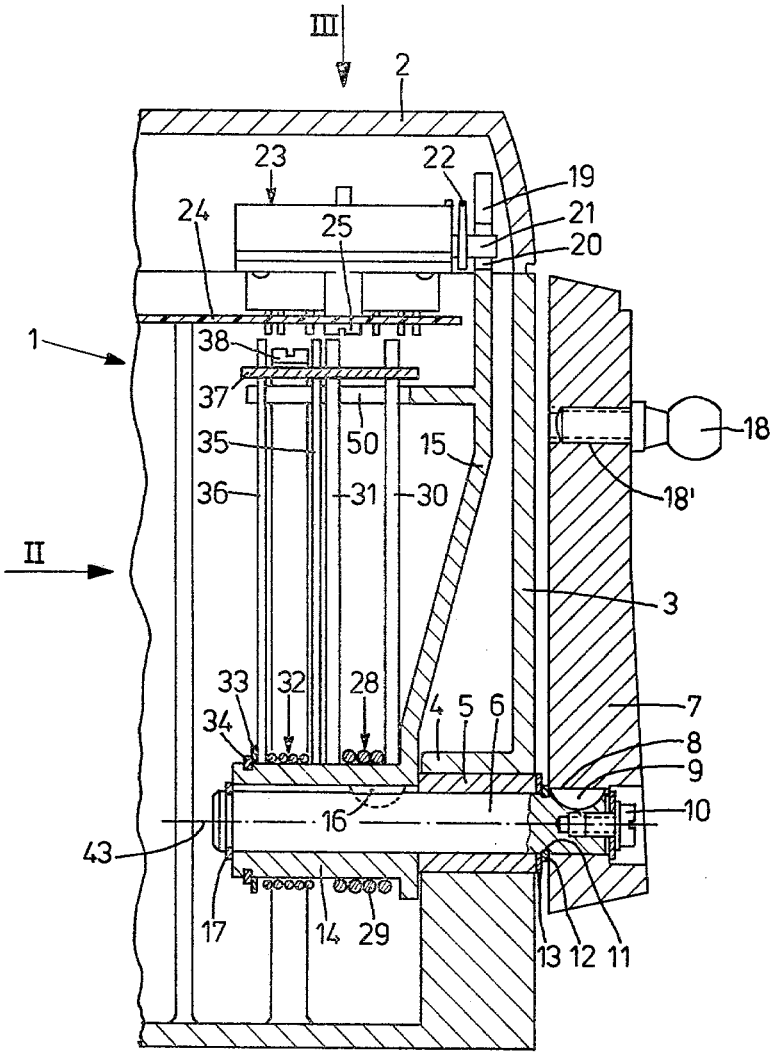
FIG. 1 is a cross-sectional view taken through an actuation apparatus according to a first embodiment of the present invention.
Figure 2:
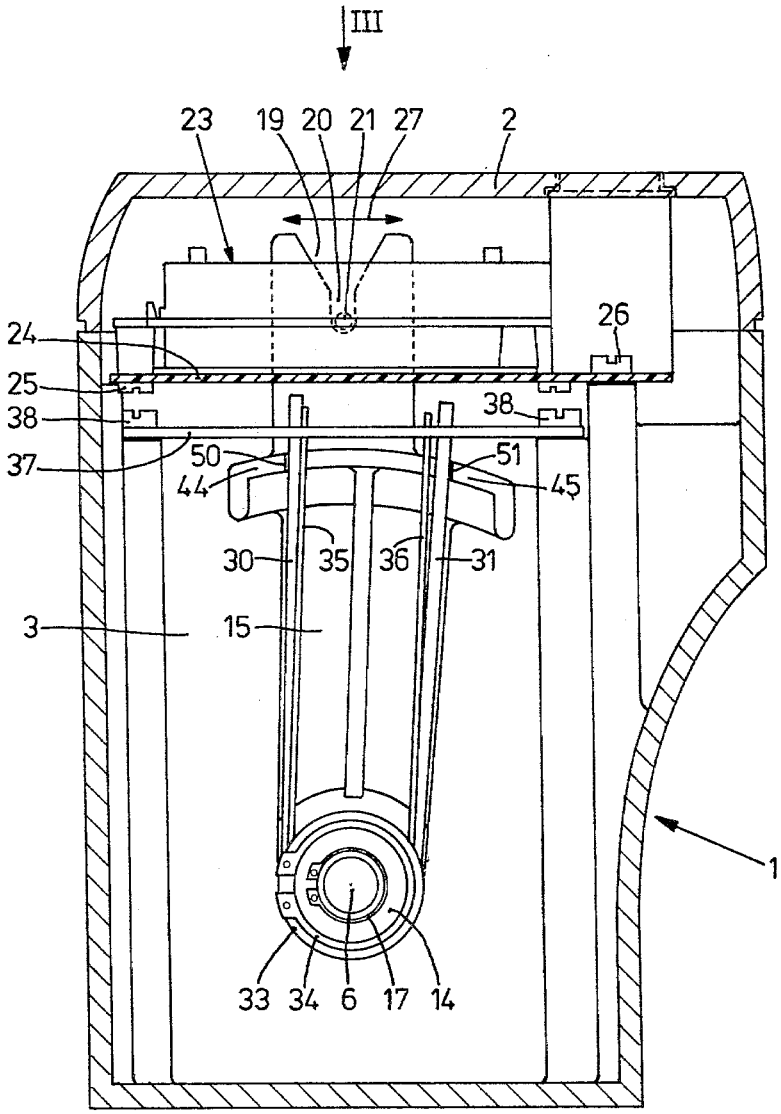
FIG. 2 is a plan view of the actuation apparatus of FIG. 1 seen in the direction of the arrow II.
Figure 3:
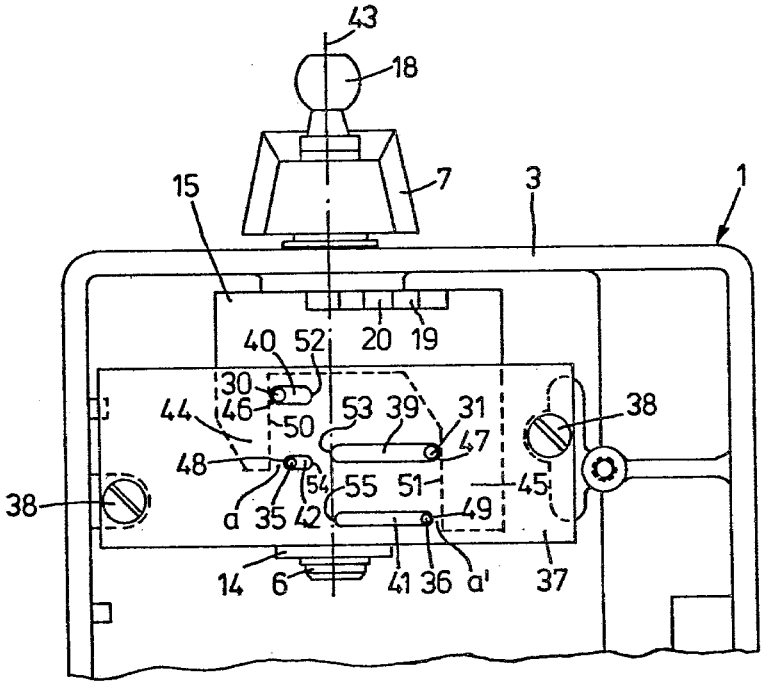
FIG. 3 is a plan view of the actuation apparatus of FIGS. 1 and 2 seen in the direction of the arrow III, the cap and the printed circuit board having been removed to expose portions of the apparatus.

Referring to FIGS. 1–3, a side portion of a control box 1 is indicated which is flanged together with a drive such as is described in detail in a periodical *Belkeidung und Wasche No.* 7, 1970, pages 466–470. This control box 1 can be closed by the means of a cap 2. Extending from a sidewall 3 of the control box 1, there is a bearing bushing 4 which could be cast at the same time as the control box is were it manufactured by die casting in the conventional manner. A bearing 5, e.g. a slide bearing, is held by a press seat in the bearing bushing 4, and a bearing shaft 6 is rotatably disposed in the bearing 5. On a portion of the shaft 6 which protrudes out of the control box 1, a lever 7 is fixedly secured in a rotationally but axially undisplaceable manner. To this end, the lever 7 is provided with a bore 8 which diameter corresponding to the shaft 6, which extends into the bore 8. The rotational fixation is attained by a parallel key 9. The lever 7 is secured against removal from the bearing shaft 6 by a screw 10. On the side oriented towards the slide bearings 5, the lever 7 rests against a securing ring 12 fixed in a groove 11 of the shaft 5. The securing ring 12, in turn, is supported against an annular disc 13 which covers the end face of the slide bearing 5.

A hub of an actuation arm 15 is placed upon a portion of the bearing shaft 6 which extends within the control parallel key 16. The hub 14 and thus the actuation arm 15 are secured against removal from the shaft 6 axially in the direction of the interior of the control box 1 by a securing ring 17. The actuation arm 15 is connected in a rotationally fixed manner to the lever 7 by the connection described.

The lever 7 has a ball and socket 18 on its free end which is threadedly inserted into a corresponding threaded bore 18'. This ball and socket 18 is a part of a conventional angle joint, by way of which a rod, e.g., is connected which leads to a pedal, so that the lever 7 and thus the actuation arm 15 can be pivoted by an operator using such a pedal.

The actuation arm 15 is connected to the hub 14 directly adjacent to an associated side of the bearing bushing 4 and it extends obliquely approximately up to the sidewall 3 of the control box 1. On its free end, the actuation arm 15 is provided with a recess 19, which has the approximate shape of a Y, as best seen in FIG. 2. In the lower leg of the Y, embodied as an oblong slot 20, a coupler tang of a switching member 22 of a control switch 23 is disposed. This control switch 23 is bolted by screws on a printed circuit board 24. The Y-shaped enlargement of the recess 19 serves the purpose of guiding the coupler tang 21 as easily as possible into the oblong slot 20 during the insertion of the preassembled printed circuit board 24. The printed circuit board 24 is bolted with the control box 1 by screws 26, as a result of which is fixed orientation of the control switch 23 and the actuation arm 15 to one another is also achieved. The control switch 23, in a known manner, is embodied as a switch provided with contact banks, and in a predetermined switching position, certain contact pairs are closed on the appropriate movements of the actuation arm 15 and thus of the switching member 22 corresponding to the arrow 27 indicating the directions of movement. Obviously a switch of this general type can also be a switch operating without contacts, and it can also be embodied as switching in infinite gradations or in discrete steps. Switches of these kinds are commercially available.

A first torsion spring 28 is placed upon the hub 14 and is embodied by a plurality of tightly wound coils 29 of spring wire, the two ends of which protrude as free arms 30, 31 upward in the direction of the control switch 23. A second torsion spring 32 is disposed on hub 14 beside this first torsion spring 28. These two torsion springs 28, 32 are secured against slipping downward by an annular disc 33 and a securing ring 34 secured to the hub 14. This second torsion spring 32 also has two free arms 35, 36.

A plate acting as a guide body 37 is disposed in the vicinity of the printed circuit board 24 between this board 24 and the hub 14. The guide body 37 thus extends approximately perpendicular to the longitudinal direction of the actuation arm 15 in its central position of rest, as viewed in FIG. 2. This guide body 37 is bolted to the control box 1 by screws 38. A first pair of slits 39, 40 is disposed in this guide body 37 which are associated with the first torsion spring 38. A second pair of slits 41, 42 is further disposed in the guide body 37 and are associated with the second torsion spring 32. The respective end of one arm 30, 31 of the first torsion spring 38 or 35, 36 of the second torsion spring 32 is guided within each slit 39, 40 and 41,42, respectively. The slits 39, 40, 41, 42 extend perpendicular to the axis 43 of the bearing shaft 5, which of course is simultaneously also the rotary axis for the arms 30, 31 and 35, 36 of the torsion springs 28 and 32.

Two couplers 44, 45 are attached to the actuation arm 15 adjacent the guide body 37 and between this guide body 37 and the hub 14. The entire actuation arm 15, with the hub 14 and the couplers 44, 45 and the recess 19, is easily formed as one piece of plastic or die-cast metal during manufacturing.

As may be seen in particular in FIG. 3, the couplers 44, 45 engage the arms 30, 35 on one side and 31, 36 on the other side from the outside. In the position of rest shown in FIG. 3, all the arms 30, 31 and 35, 36, because of their prestressing, rest against the respective ends remote from one another, i.e. the other ends, of the slits 39 through 42 embodied as oblong slots. These ends thus act as initial stops 46, 47 and 48, 49, respectively, relative to a deflection of the arms 30, 31 and 35, 36, respectively. In this position of the two arms 30, 31 of the first torsion spring 28 at the associated initial stop 46, 47, the two couplers 44, 45 rest with their coupler faces 50, 51 oriented towards the arms against the outer side of these two arms 30, 31. As a result, the actuation arm 15 and the lever 7, are contemporantiously held in this position of rest and free of play. The control switch 23 or its switching member 22 with the coupler tang 21 is disposed in such a manner that at the position, thus defined, of the actuation arm 15 a zero position is also established in the control switch 23.

The slits 41, 42 associated with the second torsion spring 32 are disposed such that in this position of rest the arms 35, 36 resting against the corresponding initial stop 48 or 49 are a small distance a and a', respectively, as best seen in FIG. 3, from the corresponding coupler faces 50 and 51, respectively. As a result it is attained that upon pivoting of the lever 7 with the actuation arm 15 in one of the directions indicated by the arrow 27 indicating direction of motion, either only the arm 30 of the first torsion spring 28 is first driven by the coupler face 50 of the coupler 44 against a corresponding counterforce before the coupler face 50 comes to contact the arm 35 of the second torsion spring 32 and then its counterface must also be overcome, or, in the case of a pivoting movement in the opposite direction, first the arm 31 of the first torsion spring 28 is driven by the coupler face 51 of the coupler 45, until after a distance a' has been travelled this coupler face 51 comes to rest against the corresponding arm 36 of the second torsion spring 32. Thus, after this distance a or a' has been overcome, a so-called pressure point appears at which once again a supplementary force must be exerted in order to perform a corresponding switching movement.

The slits 40, 42 and 39, 41 associated respectively with one coupler 44 or 45 and at one and the same level, so that those arms 30, 35 or 31, 36 simultaneously come to rest on those ends of the slits 39 through 42 acting as end stops 52, 53, 54, 55.

It will be appreciated that even when the second torsion spring 32 is omitted and thus when the pressure points are omitted, the embodiment having only torsion spring 28, whose arms 30, 31 are guided in the slits 39, 40 having the initial stops 46, 47 and the end stop 52, 53 is also very simple and thus very advantageous.

Obviously, it is possible and it may be advantageous, depending on the intended application, to provide the torsion springs 28, 32 with different spring characteristics, i.e. to embody these springs with differing rigidity. Thus if the second torsion spring 32 is embodied as relatively more yielding than the first torsion spring 28, then upon overcoming the pressure point, i.e. when the second torsion spring 32 additionally becomes effective as well, no significant increase in force occurs for the purpose of actuating the lever 7 with the actuation arm 15. If in contrast the first torsion spring 28 is relatively more yielding than the second torsion spring 32, then the actual increase in force, i.e. the increase in the counterforce, occurs only upon engagement of the second torsion spring 32.

A further factor is the various degree of pre-stressing of the individual springs. In the case of the second torsion spring 32, of course the entire pre-stressing force must be overcome after the particular coupler 44 or 45 comes to rest against the corresonding arm 35 or 36 of the second torsion spring 32, before a further deflection of the corresponding coupler with the actuation arm 15 occurs. As a rule, it is thus efficient to embody the second torsion spring 32 as relatively more yielding than the first torsion spring 28 and vice versa to prestress the second torsion spring 32 correspondingly heavily, so that the desired counterface appears at the pressure point. After this force is overcome at the pressure point, then no significant increase of the counterface occurs over the course of pivoting by the corresponding arm 35 or 36 of the second torsion spring 32. The effects described above can be realized in a particularly simple manner by making the second torsion spring 32 on the one hand out of a thinner i.e., more yielding, spring wire than the first torsion spring 28, and on the other hand by embodying the second spring 32 as having a number of coils more than the first torsion spring 28. This is indicated in FIG. 1. This first described embodiment is less satisfying in esthetic terms; however, as a result of the disposition of the actuation apparatus in the interior of the control box, it can be realized in simple fashion.

Furthermore, it is naturally also possible to shift the initial stops 48 or 49 of the arms 35, 36 of the second torsion spring 32 to only one side, i.e. to shift them by the distance a or a' at the slit 41 or 42 relative to the associated initial stop 46 or 47, so that only upon pivoting of the actuation arm 15 out of a position of rest in one of the two possible directions it is a pressure point generated after the correspondingly short distance a or a' has been travelled.

Naturally a single guide body 37 can also be equipped with appropriate combinations of slits for the arms 30, 31 and 35, 36, so that all three of the combinations described above can be realized in selective fashion.

Figure 4:
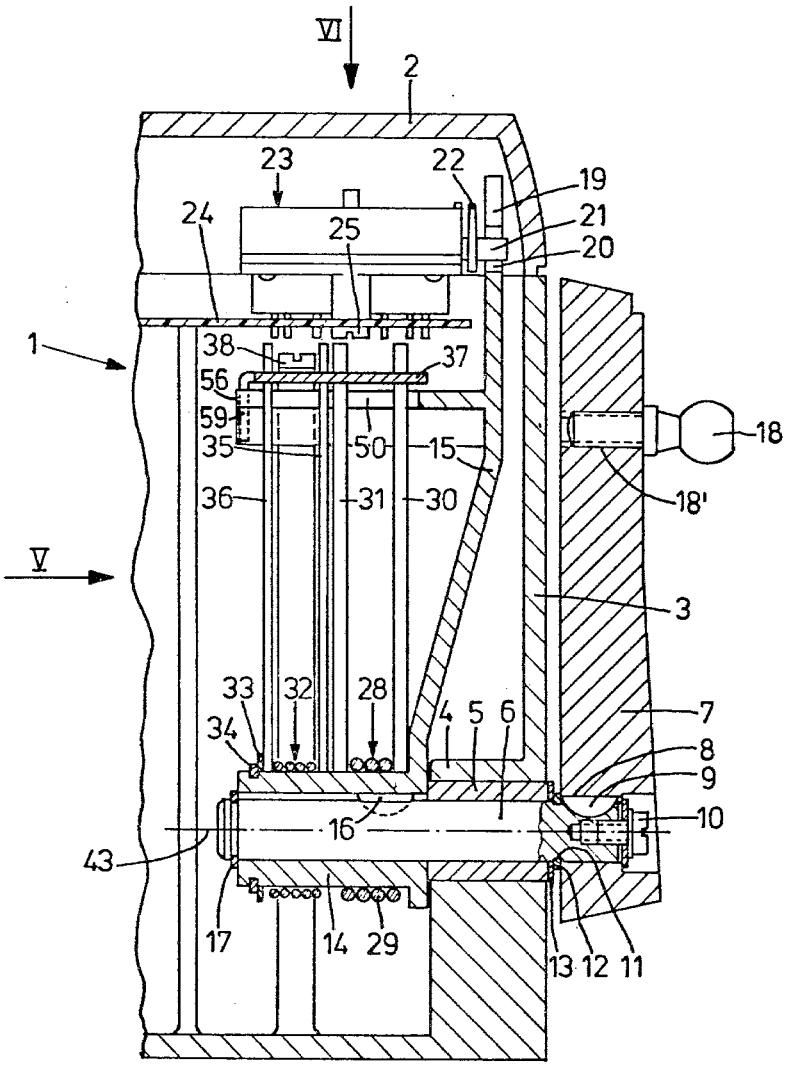
FIG. 4 is a cross-sectional view taken through an actuation apparatus according to a second embodiment of the present invention.
Figure 5:
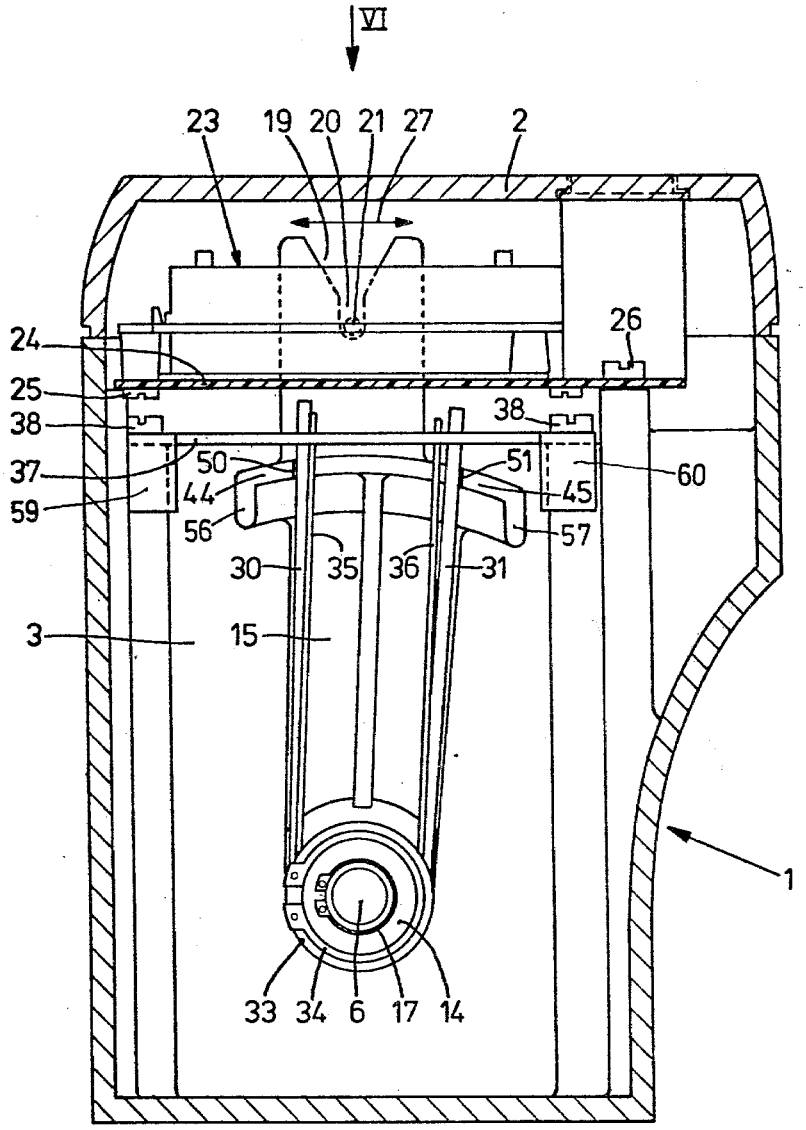
FIG. 5 is a plan view of the actuation apparatus of FIG. 4 seen in the direction of the arrow V.
Figure 6:
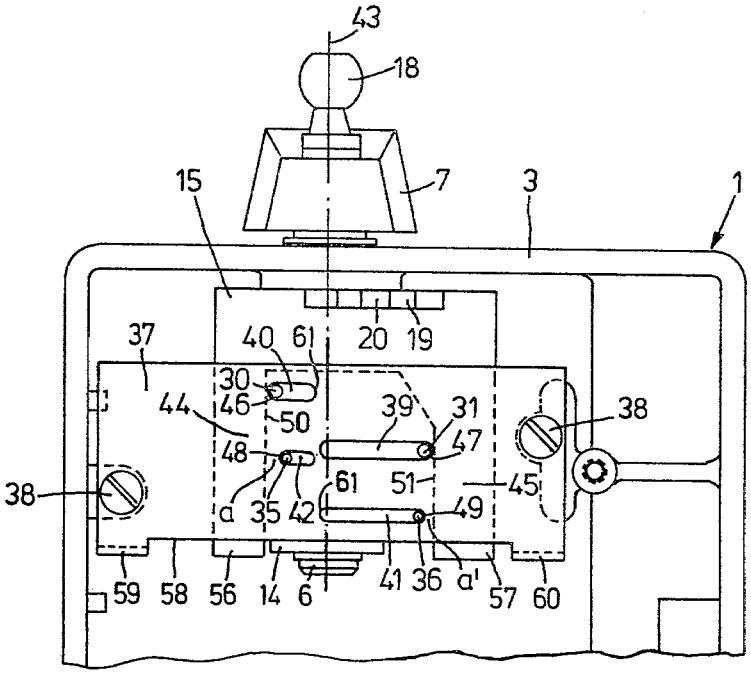
FIG. 6 is a plan view of the actuation apparatus of FIGS. 4 and 5 seen in the direction of the arrow VI, the cap and printed circuit board having been removed to expose portions of the apparatus.

In contrast to the first exemplary embodiment illustrated in FIGS. 1–3, in the second exemplary embodiment shown in FIGS. 4–6, the couplers 44, 45 embodied on the actuation arm 15 are provided respectively with extensions 56, 57 which protrude beyond the rim 58 of the guide body 37 oriented towards their free ends. In the vicinity of this rim, end stops 59,60 in the form of tongues, strips or protrusions, are bent downwards out of the guide body 37, which is a sheet metal plate, i.e. in the direction of the bearing shaft 6. The extension 56 of the coupler 44 or the extension 57 of the coupler 45 comes to rest, against the end stops 59, 60, this providing a switching path limitation feature. In order not to change the length of the switching paths, the slits 39, 40, 41, 42 are provided, in contrast to the exemplary embodiment described above, with a slight slit extension 61 on the end opposite the initial stops 46, 47, 48, 49. Thus it is assured that when the extension 56 or 57 of the coupler 44 or 45 comes to contact the associated end stop 59 or 60, which is embodied like a tongue or protrusion, the arms 30, 31 or 35, 36 do not contact the end of the slits on the guide body 37.

If the coupler 44 strikes the end stop 59 with its extension 56, then this end stop 59 represents an end stop for the arms 31 or 36 of the torsion springs 28, 32, respectively. In reverse fashion, the end stop 60 in cooperation with the extension 57 of the coupler 45 acts as the end stop for the arms 30, 35 of the two torsion springs 28, 32.

It is to be understood that the foregoing description and the accompanying drawings of the preferred embodiments are given entirely by way of an example and not by way of limitation. It is to be appreciated that other embodiments and variants of the invention are without departing from the scope of the invention, its scope being defined by the appended claims.

What is claimed is:

1. In an actuation apparatus for a control switch operated by a switching member, a pivoting shaft and an actuation arm mounted on said pivoting shaft with a torsion spring, said switch producing various control signals in accordance with the position of the switching member, means to couple said actuation ar with the switching member, said actuation arm being supported, pivotably from a central position of rest, about an axis defined by the pivoting shaft counter to the restoring force of the torsion spring, said spring comprising offstanding free arms, wherein one respective stationary initial stop is provided for each free arm for the purpose of fixing the respective positions of the arms in a position of rest and wherein at least one coupler contacting the free arms is connected with the actuation arm, the improvement comprising a respective additional stop, acting as a respective end stop limiting the switch path operatively associated with each said free arm of said torsion spring.

2. An apparatus as defined by claim 1, including a further torsion spring coaxial to the first said torsion spring, said further torsion spring including free arms which rest against said initial stops, said free arms of said second torsion spring being deflectable by at least one coupler up to a point of rest against further end stops and wherein a free distance (a or a') exists between said coupler and at least one of said free arms in the position of rest.

3. An apparatus as defined by claim 1 or 2, wherein pairs composed by respective ones of said initial stops and respective ones of said ends stops associated with each said free arm is embodied by respective slits in a guide body.

4. An apparatus as defined by one of the claim 1 or claim 2, wherein said actuation arm is provided with two couplers disposed at a distance from one another, which in the position of rest lie in contact with a respective one of said free arms of the first said torsion spring.

5. An apparatus as defined by claim 2, wherein said free arms of the first said torsion spring and said further torsion spring associated with respective said coupler, in a corresponding position of the said actuation arm deflected out of its position of rest, rest against respective ones of said end stops.

6. An apparatus as defined by claim 2, wherein the first said torsion spring and said further torsion spring have different spring characteristics.

7. An apparatus as defined by claim 6, wherein in said further torsion spring is more yielding thant the first said torsion spring.

8. An apparatus as defined by claim 6, wherein said further torsion spring has a flatter characteristic curve with respect to the characteristic curve of the first said torsion spring.

9. In an actuation apparatus for a control switch operated by a switching member, a pivoting shaft and an actuation arm mounted on said pivoting shaft with a torsion spring, said switch producing various control signals in accordance with the position of the switching member, means to couple said actuation arm with the switching member, said actuation arm being supported, pivotably from a central position of rest, about an axis defined by the pivoting shaft counter to the restoring force of the torsion spring, said spring comprising offstanding free arms, wherein one stationary initial stop is provided for each free arm for the purpose of fixing the respective positions of the arms in a position of rest, wherein the actuation arm is provided with two couplers disposed at a distance from one another and in contact with the free arms, wherein a second, stationary end stop limiting the switching path is associated with each said free arm of the torsion spring, and wherein the initial stop associated with each said free arm is embodied by a respective slit in a guide body, the improvement wherein said end stops associated with each said free arm are respectively embodied by a respective protrusion on a guide body disposed in the path of at least one coupler.

10. An apparatus as defined by claim 9, wherein said end stops are integral with said guide body.

11. An apparatus as defined by claim 10, wherein respective said end stops are embodied by a respective downwardly bent portion on said guide body.

12. An apparatus as defined by claim 9 or 10, including a further torsion spring positioned coaxially with the first said said torsion spring, whose free arms rest against said initial stops and are deflectable by said two couplers up to a point of impact against respective said end stops, wherein a free distance (a or a') exists between at least one of said couplers and at least one of said free arms of said additional torsion spring in the position of rest.

13. An apparatus as defined by claim 12 wherein the first said spring and said further torsion spring have different spring characteristics.

14. An apparatus as defined by claim 13, wherein said further torsion spring is more yielding than the first said torsion spring.

15. An apparatus as defined by claim 13, wherein said further torsion spring has a flatter characteristic curve than the first said torsion spring.

* * * * *